US009723927B2

(12) United States Patent
Huang

(10) Patent No.: US 9,723,927 B2
(45) Date of Patent: Aug. 8, 2017

(54) CHAIR SUPPORTING STRUCTURE

(71) Applicant: Tsung-Chieh Huang, Kaohsiung (TW)

(72) Inventor: Tsung-Chieh Huang, Kaohsiung (TW)

( * ) Notice: Subject to any disclaimer, the term of this patent is extended or adjusted under 35 U.S.C. 154(b) by 91 days.

(21) Appl. No.: 14/658,253

(22) Filed: Mar. 16, 2015

(65) Prior Publication Data

US 2016/0270538 A1 Sep. 22, 2016

(51) Int. Cl.
*A47C 7/02* (2006.01)
*A47C 7/00* (2006.01)
*A47C 3/12* (2006.01)

(52) U.S. Cl.
CPC ..... *A47C 7/002* (2013.01); *A47C 3/12* (2013.01)

(58) Field of Classification Search
CPC ..... A47C 4/02; A47C 5/10
USPC ..... 297/440.22
See application file for complete search history.

(56) References Cited

U.S. PATENT DOCUMENTS 3,089,730 A * 5/1963 Mauser ..... A47C 5/04 248/188
5,335,377 A * 8/1994 Masyada ..... A47K 3/122 297/152
6,843,529 B2 * 1/2005 Ballendat ..... A47C 3/04 297/239

* cited by examiner

*Primary Examiner* — Sarah McPartlin

(57) ABSTRACT

A chair supporting structure comprises a base frame having a plurality of connecting arms which is downwardly inclined; a lower distal end of each connecting arm being formed with outer threads for combining with the connecting units; a plurality of legs being installed at a bottom of the a seat of a chair; an upper end of each leg being formed with an insertion hole; and a plurality of combining units for combining the base frame and let set; an upper end of the combining unit being formed with a combining hole which has inner threads; so that the outer threads of each combining arm being threadly engaged with the inner threads of the combining hole of the combining unit; a lower end of the combining unit being tightly engaged to the insertion hole so that the base frame is combined with the legs.

2 Claims, 3 Drawing Sheets

CHAIR SUPPORTING STRUCTURE

SUMMARY OF THE INVENTION

The present invention relates to chairs, and in particular to a chair supporting structure, in that a connecting unit is used to combine the base frame and the legs of the chair so that it provides a firm and concrete structure which is easily assembled and has a simple structure.

BACKGROUND OF THE INVENTION

Prior indoor chairs could be dining chairs, office chairs and lounge chairs. They generally use woods, metals and plastic as manufacturing materials under the consideration of structures and shapes in design. Using various materials will present the different qualities and corresponding structure techniques of the chairs. The application of materials generally depends on the consideration of design. Due to the limitation of physical properties and strengths of different materials, Bendability of woods is not well and the strength thereof is worse than the metal. Metal has a higher strength, but also the bendability thereof is limited. Plastic material has high plasticity to match design demands and is suitable to form various 3D-streamline art models.

Meanwhile, using plastic would lower consumption of wood and is reusable and thus it is economic. Due plastics is quite and the strength thereof is weak, synthetic material is applied to promote the combined strength and durability of the plastic parts. Using downwards expanding legs in chairs usually increase coverable and stability of chairs and also crossing linkages between legs are used to reinforce the strengths of legs and enhance ability of supporting of goods thereon. However, it causes un-removable members between legs and limits the advantages of plastics for easily molding and matching the model design idea in art shape.

Moreover, volumes of plastic chairs are constant so that costs for transportation are increased. Some synthetic material assemblies are used to be combined with the chairs. Although it has shapeable and is full of artistic performance, the combination of metal parts and chair legs often explode due to crushing of plastics, as a result lifetimes of the chairs are reduced. In particular, threaded parts between bottoms of metal chairs and the plastic legs often crush to cause loosen chair legs fail in use. Replacing new leg is one permissible solution, however. To abandon the whole leg with crushing thread only causes waste of goods. Therefore, there is a new task in technique invention to improve the connection between the metal chair bottom and plastic leg for prolonging lifetime and increasing the worth thereof, minimizing replacement costs.

SUMMARY OF THE INVENTION

Accordingly to improve above defects in the prior arts, the present invention provides a chair supporting structure, in that the structure of the present invention can be widely used in different kinds of charms; the user can assembled the base frame to the legs by themselves (DIY) for assembling a chair or updating the assembly of the chair so as to match the requirement in decoration or environmental requirement. The structure of the chair is concrete with less elements and easily assembly. The lost in investment and assembly is low and the assembly work is easy with less space and transportation cost. When the connecting units are destroyed, it is only to update the connecting unit for prolong the lifetime of the chair, while the use of the chair is not reduced. Since the structure is simple, it can be manufactured rapidly and effectively. Therefore, it is economic and industrial useful.

To achieve above object, the present invention provides a chair supporting structure comprising a base frame having a plurality of connecting arms which is downwardly inclined; a lower distal end of each connecting arm being formed with outer threads for combining with the connecting units; a plurality of legs being installed at a bottom of the a seat of a chair; an upper end of each leg being formed with an insertion hole; and a plurality of combining units for combining the base frame and let set; an upper end of the combining unit being formed with a combining hole which has inner threads; so that the outer threads of each combining arm being threadly engaged with the inner threads of the combining hole of the combining unit; a lower end of the combining unit being tightly engaged to the insertion hole so that the base frame is combined with the legs.

DESCRIPTION OF THE DRAWINGS

Figure 1:
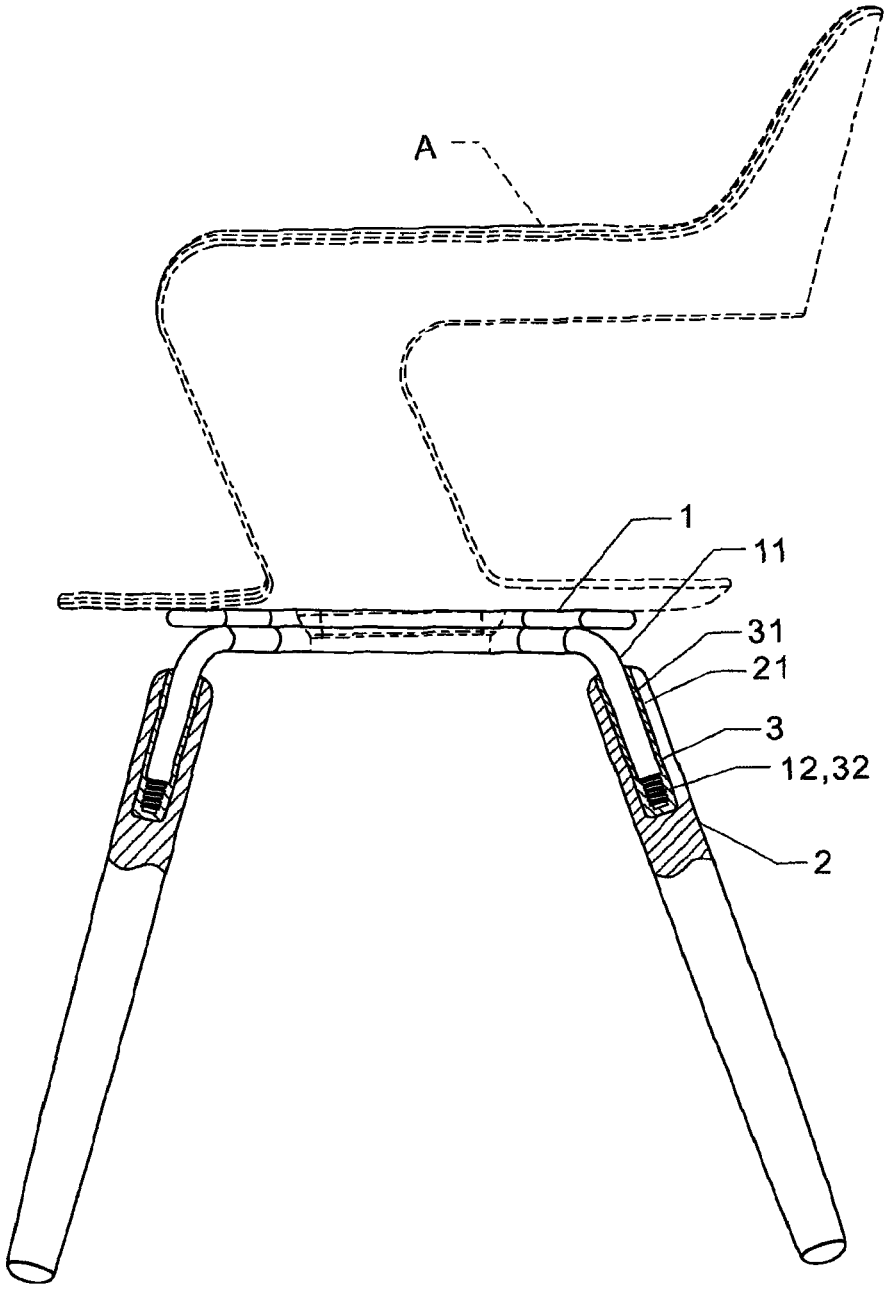
FIG. 1 is a cross sectional view the present invention.
Figure 2:
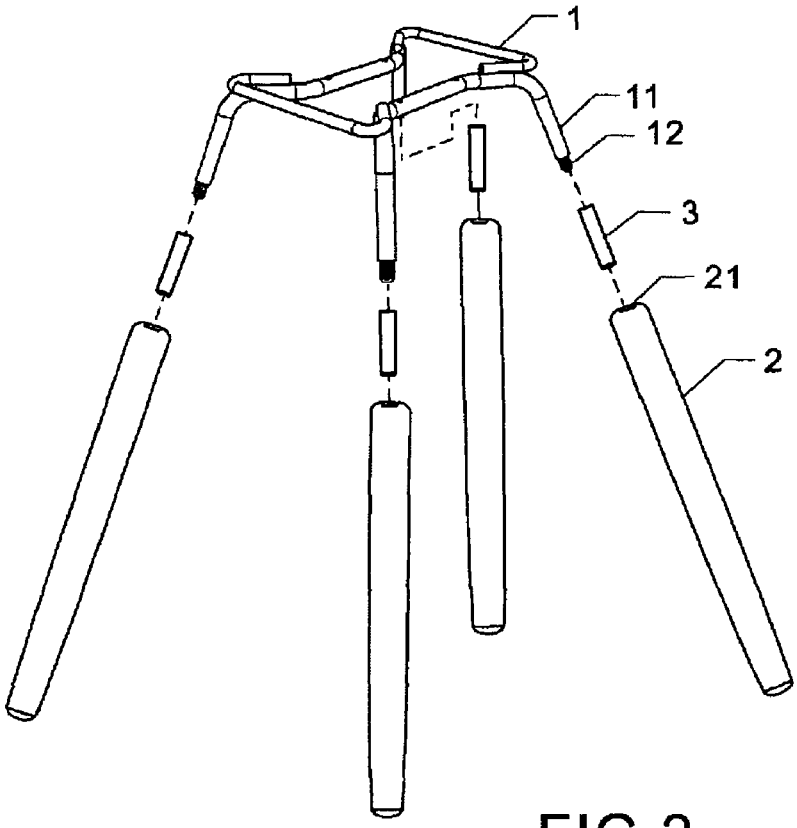
FIG. 2 is an assembly view of the present invention.
Figure 4:
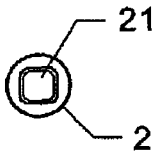
FIG. 4 is a left side view of FIG. 3.
Figure 3:
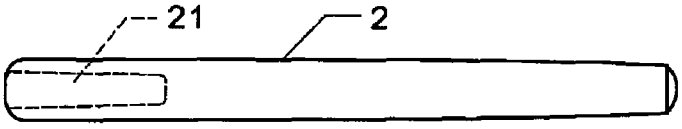
FIG. 3 shows the chair legs of the present invention.
Figure 6:
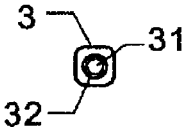
FIG. 6 is a left side view of the present invention.
Figure 5:
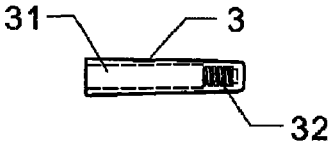
FIG. 5 is an assembly view of the present invention.
Figure 7:
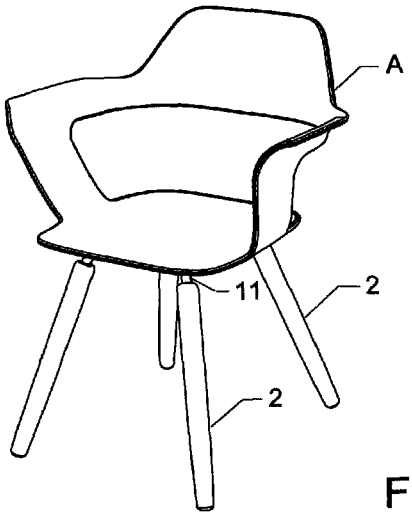
FIG. 7 is a perspective view of the present invention.
Figure 8:
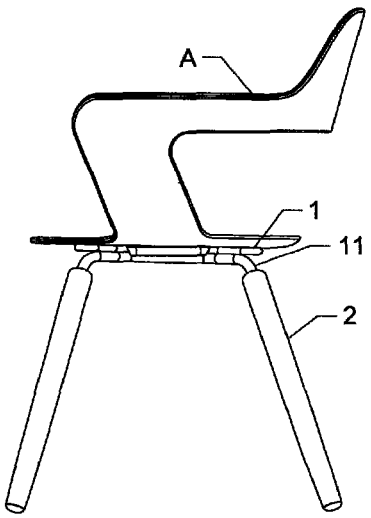
FIG. 8 is a right side view of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 8, the structure of the present invention is illustrated. The present invention includes the following elements:

A base frame 1 has a plurality of connecting arms 11 (in the drawings, four arms are shown) which is downwardly inclined. A lower distal end of each connecting arm 11 is formed with outer threads 12 for combining with the connecting units 3.

A plurality of legs 2 are installed at a bottom of the a seat A of a chair. An upper end of each leg 2 is formed with a non-round insertion hole 21 (in the drawing 2, it is shown that a rectangular hole is shown).

A plurality of combining units 3 serve for combining the base frame 1 and legs 2. An upper end of the combining unit 3 is formed with a combining hole 31 which has inner threads 32. The upper end of the combining unit 3 has a shape like the lower distal end of the connecting arm 11 so that the outer threads 12 of each combining arm 11 is threadly engaged with the inner threads 32 of the combining hole 31 of the combining unit 3.

A lower end of combining unit 3 has a shape like the insertion hole 21 of the leg 2 so that the combining unit 3 is tightly engaged to the insertion hole 21 so that the base frame 1 is combined with the legs 2.

The cross section of the insertion hole 21 of the leg 2 and the combining hole 31 of the combining unit 31 may have any desired shapes, such as rectangular shapes, round shapes etc. which are not confined to the scopes shown in the drawings.

Referring to FIG. 1, in assembly, the outer threads 12 of the connecting arms 11 of the base frame 1 are inserted into the combining holes 31 of the combining units 3 by the outer threads 12 engages to the inner threads 32. Then the lower distal ends of the combining units are tightly engaged to the insertion holes 21 of the legs. As a result, the base frame 1 is assembled to the legs firmly.

Advantages of the present invention are that the structure of the present invention can be widely used in different kinds of charms; the user can assembled the base frame 1 to the legs by themselves (DIY) for assembling a chair or updating the assembly of the chair so as to match the requirement in decoration or environmental requirement. The structure of the chair is concrete with less elements and easily assembly. The lost in investment and assembly is low and the assembly work is easy with less space and transportation cost. When the connecting units are destroyed, it is only to update the connecting unit for prolong the lifetime of the chair, while the use of the chair is not reduced. Since the structure is simple, it can be manufactured rapidly and effectively. Therefore, it is economic and industrial useful.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A chair supporting structure comprising:

a seat;

a rectangular base frame installed below the seat;

a plurality of connecting arms downwardly inclined from the rectangular base frame, a lower distal end of each connecting arm being formed with outer threads;

a plurality of legs installed below the seat of the chair; an upper end of each leg being formed with a non-round insertion hole;

a plurality of combining units for combining the rectangular base frame and the plurality of legs, an upper end of each of the plurality of combining units being formed with a combining hole having inner threads, the upper end of each of the plurality of combining units being shaped like the lower distal end of each of the plurality of connecting arms, and the outer threads of each of the plurality of connecting arms being threadably engaged with the inner threads of each combining hole of each of the plurality of combining units; and a lower end of each of the plurality of combining units have a shape like the insertion hole of each of the plurality of legs so that each combining unit is tightly engaged within the insertion hole and the base frame is combined with the plurality of legs, wherein after engagement an entire length of each of the plurality of combining units is received within each of the insertion holes.

2. The chair supporting structure of claim 1, wherein a cross section of the insertion hole of each of the plurality of legs is rectangular.

* * * * *